United States Patent [19]

Haney

[11] 4,320,601

[45] Mar. 23, 1982

[54] WET SANDER

[76] Inventor: John W. Haney, 2030 S. Marietta St., Gastonia, N.C. 28052

[21] Appl. No.: 183,885

[22] Filed: Sep. 4, 1980

[51] Int. Cl.[3] ..... B24D 15/02

[52] U.S. Cl. ..... 51/391; 51/358; 401/137

[58] Field of Search ..... 51/170 R, 170 TL, 170 MT, 51/134.5 F, 262 A, 266, 267, 358, 382, 388, 391, 392, 393; 401/27, 137, 139, 203, 204

[56] References Cited

U.S. PATENT DOCUMENTS

| | | | |
|---|---|---|---|
| 1,700,114 | 1/1929 | Thompson | 51/267 X |
| 1,849,322 | 3/1932 | Weiler | 401/137 X |
| 2,262,166 | 11/1941 | Cooley | 401/203 X |
| 2,765,593 | 10/1956 | Salmon et al. | 51/392 X |
| 2,922,177 | 1/1960 | Hudson | 51/382 X |
| 3,000,202 | 9/1961 | Granados | 401/137 X |
| 3,395,495 | 8/1968 | Powanda | 51/267 X |
| 4,102,084 | 7/1978 | Bloomquist | 51/267 X |
| 4,175,359 | 11/1979 | Teague et al. | 51/267 X |

FOREIGN PATENT DOCUMENTS

| | | | |
|---|---|---|---|
| 7609814 | 3/1978 | Netherlands | 51/391 |

*Primary Examiner*—Stephen G. Kunin
*Assistant Examiner*—Robert P. Olszewski
*Attorney, Agent, or Firm*—Clifton T. Hunt

[57] ABSTRACT

The wet sander is a manually operable sanding block including means for releasably attaching successive sheets of sandpaper. A fluid conduit extends through the sanding block and includes means for attachment to a source of water. The conduit terminates in an outlet exteriorally of the block so that water can be sprayed on the work surface being sanded adjacent the sanding block. A valve is connected to the conduit within the sanding block and the control handle for the valve is located exteriorally of the block so the fluid flow through the block may be controlled.

3 Claims, 6 Drawing Figures

WET SANDER

BACKGROUND OF THE INVENTION

Wet sanders have long been known, as exemplified by U.S. Pat. No. 3,110,993 issued Nov. 19, 1963 to Cooper R. Grage, U.S. Pat. No. 3,395,495 issued Aug. 6, 1968 to Stephen Powanda, U.S. Pat. No. 4,091,577 issued May 30, 1978 to Antonio Ortiz, U.S. Pat. No. 4,102,084 issued July 25, 1978 to Thomas N. Bloomquist and U.S. Pat. No. 4,175,359 issued Nov. 27, 1979 to Walter D. Teague, Jr. et al.

To Applicant's knowledge, nobody has heretofore combined the advantages of flowing water with a manually operable sanding box. All wet sanders in the prior art known to Applicant utilize power means for movement of the sandpaper across the work surface, but Applicant's device utilizes what is, except for the fluid delivery system, a conventional hand-held manually operable sanding block with a strip of sandpaper releasably attached thereto.

The mechanized devices of the prior art certainly have their utility but the utility of the power devices does not extend to reaching obscure places or to the light touch required for the final finish when repairing an automobile body where only a manually operable sanding block with the advantages of a flushing fluid will do the job.

SUMMARY OF THE INVENTION

The utilization of water with a sanding operation is known to facilitate the work by flushing away the loosened material before it can dig into and unduly mar the finished work.

There are occasions, particularly in the sanding of automobile bodies, where a powered sander will not reach the work area and Applicant's invention produces an improved means for utilizing a flow of water with a manually operable sanding block which can be used to reach the most obscure work area. Manually operable sanding blocks are also useful in making a final and smooth finish on an automobile body after the more rapidly operable power sanders have done the rough work. Water has been used with manually operable sanding blocks in the past, as by the operator using one hand for sanding and one hand to hold the water hose to apply water to the work surface from time to time. But this is a time-consuming and cumbersome practice, which is overcome by the present invention.

According to the invention, a manually operable sanding block is provided with the advantages of running water by incorporating into the body of the sanding block a fluid conduit extending externally of the body of the sanding block for connection with a source of water and for delivering water to the work surface.

The sandpaper is held in place across one surface of the sanding block by conventional pins carried by the sanding block and which penetrate the ends of the sheet of sandpaper to releasably hold it in place during use. A tube or a fluid conduit extends through the body of the sanding block in an L-shaped path and extends from one side of the sanding block where it has means for attachment to a flexible hose leading to a water source. The tube or water conduit also extends from one end of the sanding block and has a downwardly directed opening through which water passes from the tube to the work surface to provide a lubricant for sanding and to flush away the loosened particles that have been removed from the work surface.

It is an object of this invention to provide a manually operable sanding block in combination with a source of water, means for delivering the water to the block, means for delivering the water on the work surface adjacent the block and means for controlling the flow of water through the block.

It is a more specific object of the invention to provide a manually operable sanding block in combination with a source of water of the type described and wherein the means for delivering water from the block to the work surface includes a tube having a sharpened end and an opening arranged to discharge fluid on the work surface, whereby successive strips of sandpaper are pierced by the tube as the strips are positioned on the block.

DETAILED DESCRIPTION OF THE INVENTION

Referring more specifically to the drawings, the numeral 10 broadly indicates a manually operable sanding block comprising a rigid base portion 11 and a resilient gripping portion 12. The block 10 is of a size to be conveniently held in a person's hand and the gripping portion 12 is rounded and shaped to fit comfortably within a person's hand as the person applies downward pressure on the block during a sanding operation.

Figure 4:
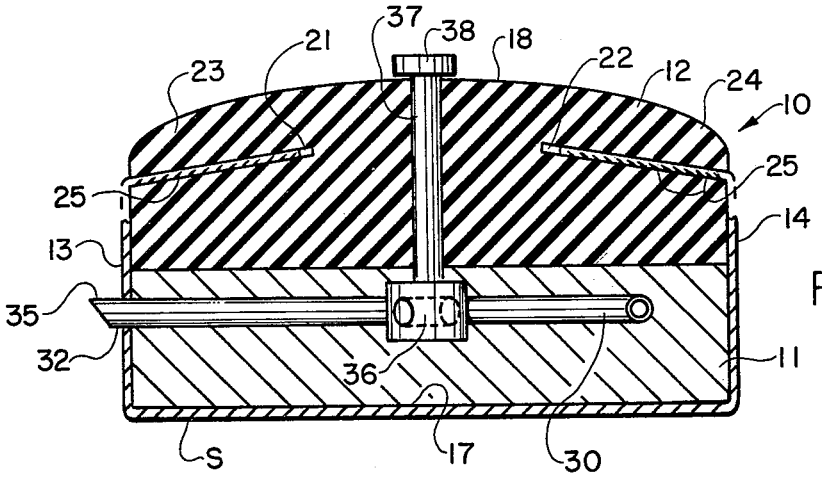
FIG. 4 is a vertical sectional view taken substantially along the line 4—4 in FIG. 2.

The gripping portion 12 is suitably secured to base 11 as by an appropriate adhesive, not shown. The sanding block 10 is of rectangular configuration including end walls 13, 14 and side walls 15, 16. The base 11 includes a lower surface 17 (FIG. 4) and the gripping portion 12 includes an upper surface 18.

The gripping portion 12 has angularly extending lines of cut 21 and 22 communicating with end walls 13, 14 respectively. The cut-away portions 21 and 22 also communicate with the side walls 15 and 16 of the block 10 and define flaps 23 and 24 at the ends of the grip portion 12.

Sharpened pins 25 are embedded in the gripping portion 12 beneath flaps 23 and 24. The pins 25 project upwardly and inwardly toward the center of the block to penetrate and retain the ends of a strip of sandpaper S which extends across the bottom 17 of base 11 and along the end walls 13 and 14 to the cut-away portions 21, 22 at each end of the block 10.

Figure 1:
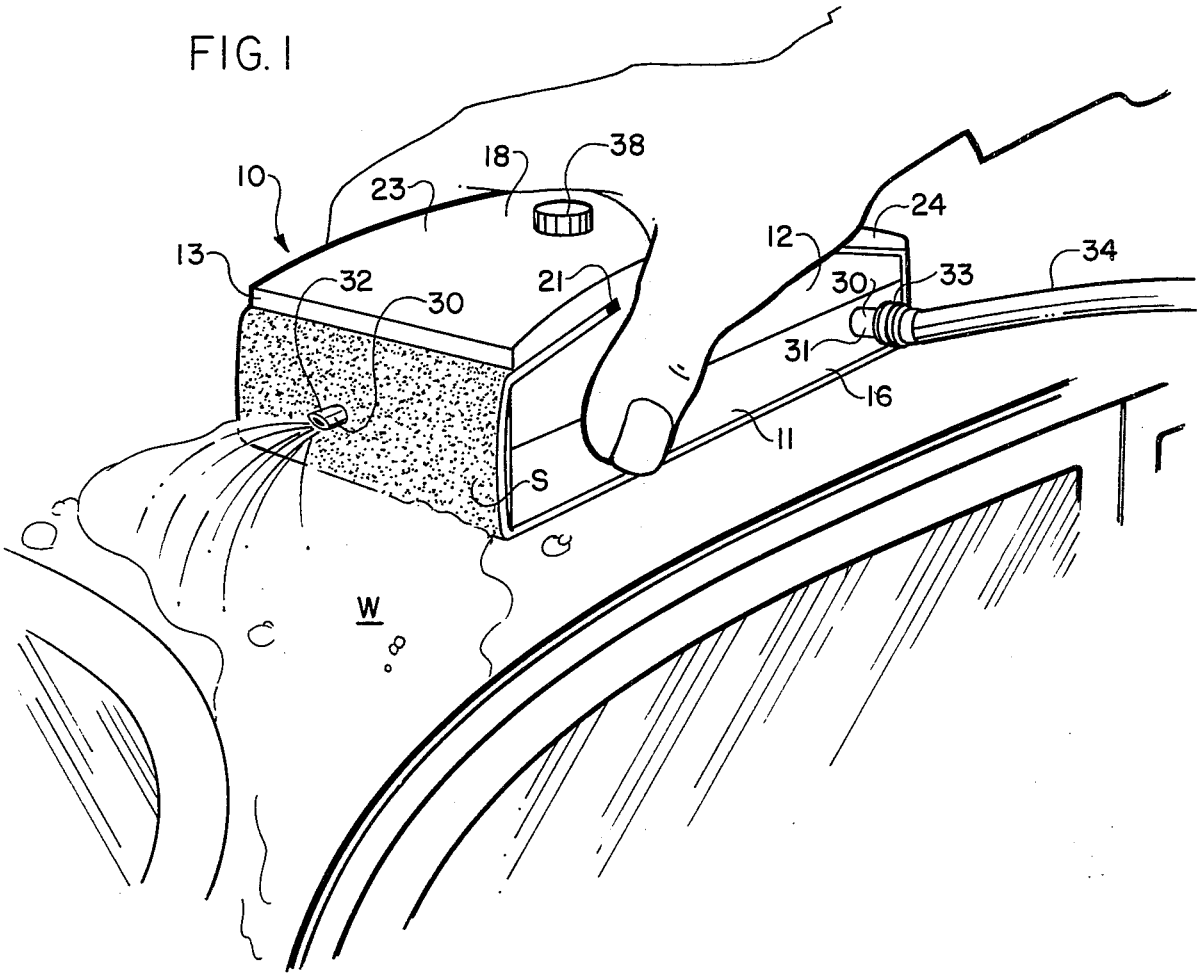
FIG. 1 is a perspective view of the wet sanding block in use.
Figure 2:
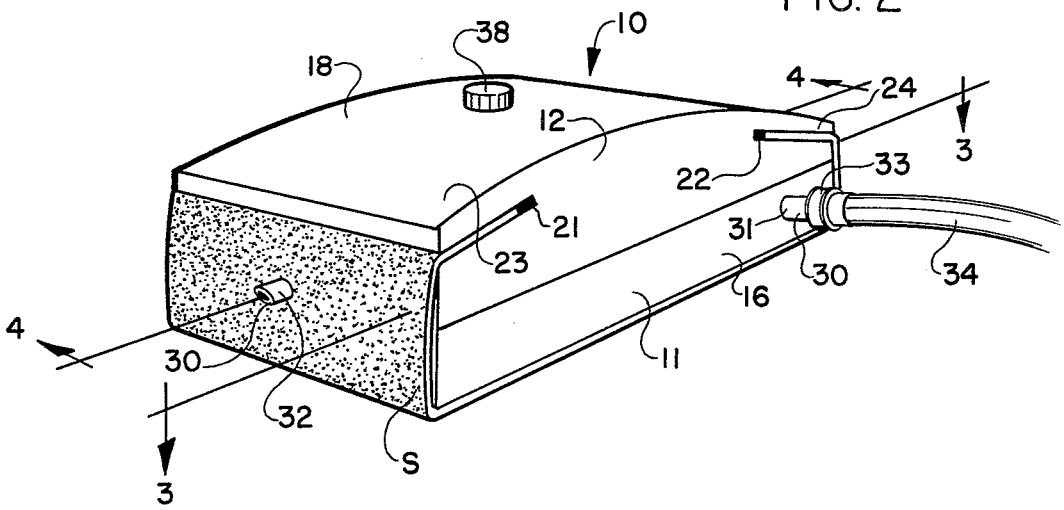
FIG. 2 is a perspective view similar to FIG. 1 and illustrating the inlet and outlet portions of the fluid conduit.
Figure 3:
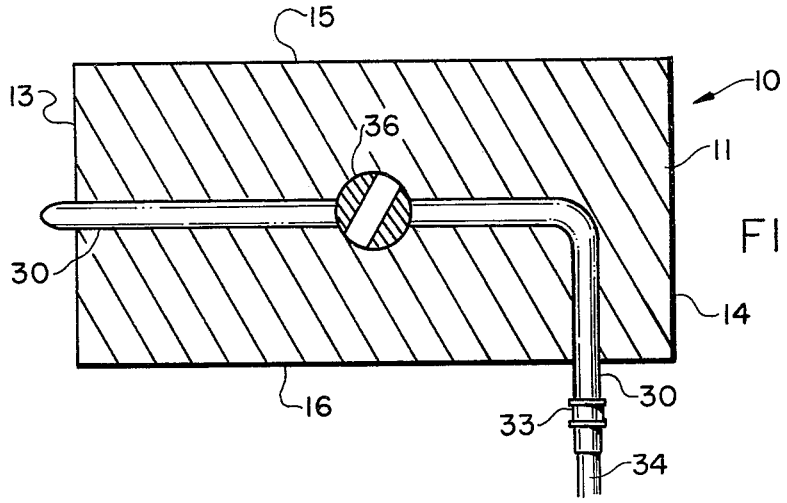
FIG. 3 is a horizontal sectional view taken substantially along the line 3—3 in FIG. 2.

The sanding block thus far described is a conventional manually operable sanding block and it is with a sanding block of this type that the invention is concerned. According to the invention fluid, such as water, may be conveniently delivered to a work surface W (FIG. 1) in association with the sanding operation by providing in the base 11 of block 10 a fluid conduit or tube 30 having an inlet 31 extending through the side wall 16 and an outlet 32 extending through the end wall 13. The outlet 31 has a conventional hose fitting 33 fixed thereto for connection to a flexible hose 34 leading to a source of water or other desired fluid, not shown. The tube 30 follows an L-shaped path through the base 11 between side wall 16 and end wall 13. The outlet 32 projects only a short distance outwardly of the end wall 13 and terminates with a sharpened point at its upper end as indicated at 35. The sharpened point 35 is useful in penetrating a sheet of sandpaper S as the paper S is attached to the block 10.

Figure 5:
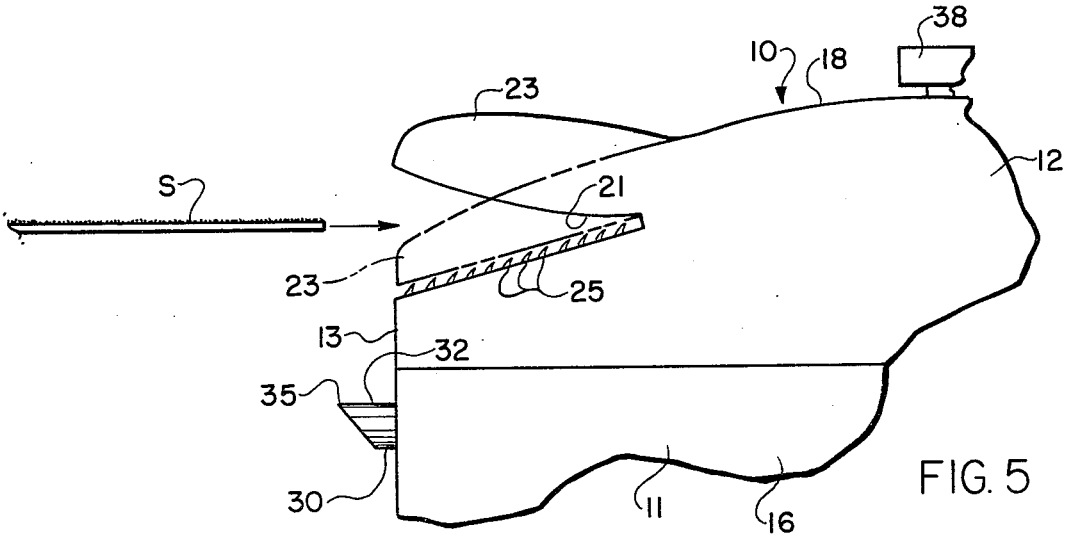
FIG. 5 is an enlarged side elevation of the sanding block, with parts broken away, illustrating the initial step in the attachment of a sheet of sandpaper to the block.
Figure 6:
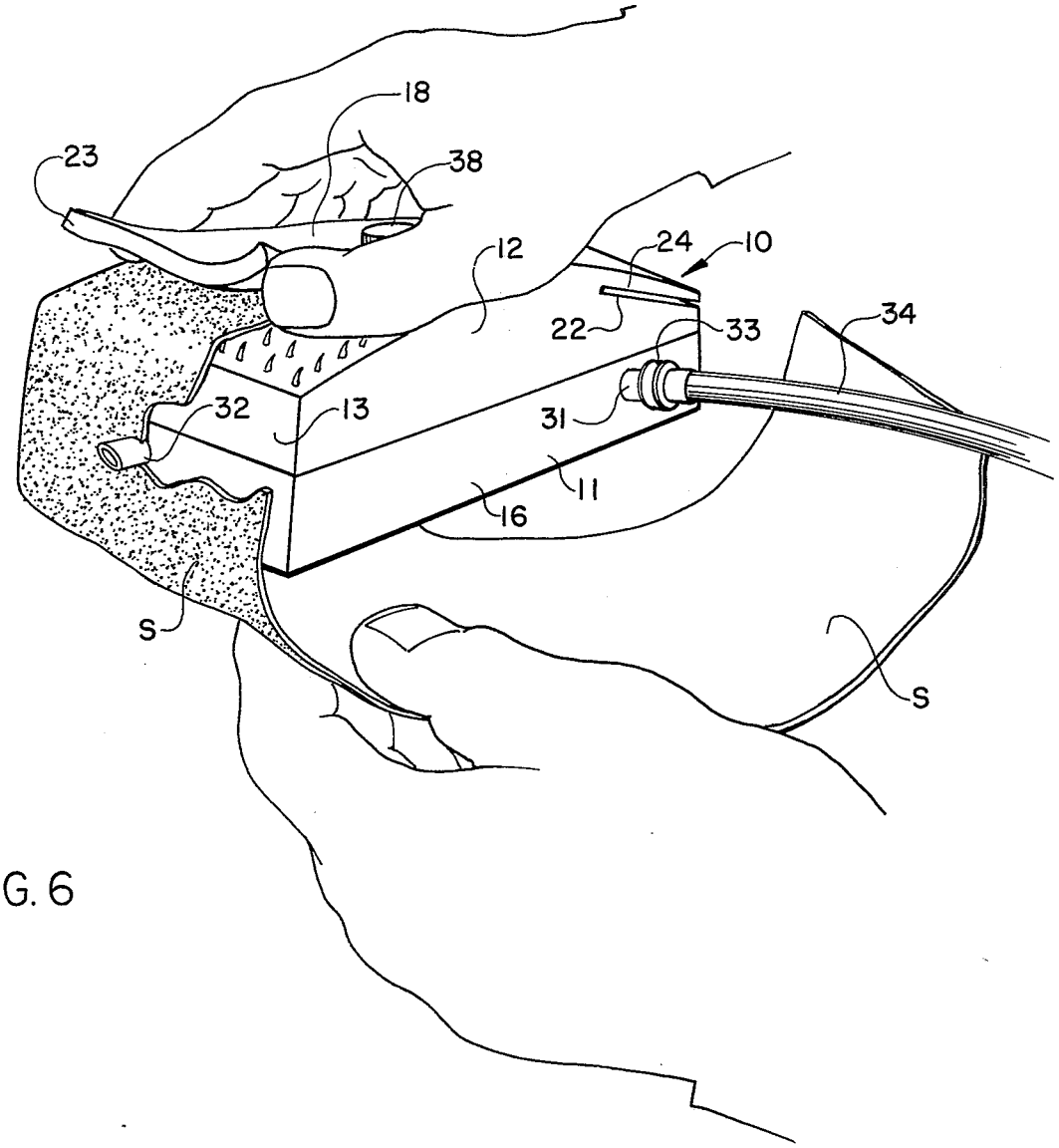
FIG. 6 is a perspective view of the sanding block illustrating subsequent steps in the attachment of a sheet of sandpaper around the outlet of the water tube.

Referring to FIGS. 5 and 6, it is seen that a sheet of sandpaper S is attached to the block by first lifting the flap 23 from its operative, dotted-line position in FIG. 5 to the elevated solid line position of FIG. 5 to provide an opening for the sheet of paper S to be positioned beneath the flap and on top of the pins 25. The flap 23 is then pressed downwardly to its dotted line position in FIG. 5, pressing the sheet of paper S downwardly around the sharpened pins 25 to cause the pins 25 to penetrate and retain the paper. Thereafter, the sheet of paper S is folded downwardly over the sharpened point 35 on outlet 32 to cause the sharpened point 35 to penetrate the sheet S, after which the sheet S is brought into snug engagement with end wall 13 and then drawn against bottom wall 17 and along end wall 14. Flap 24 is then elevated to provide an opening to receive the corresponding end of sheet S, after which the flap 24 is pressed downwardly to push sheet S over the pins 25 which penetrate and retain the end of sheet S against end wall 14.

A valve 36 is positioned in tube 30 and includes a valve stem 37 with a knurled knob 38 above the upper surface 18 of grip portion 12. The knurled knob 38 may be manipulated to open or close the valve and to adjust the flow of fluid through the tube 30.

With the sanding block 10 equipped with tube 30 and connected to a source of fluid, the operator may conveniently adjust the flow of fluid from the outlet 32 to lubricate the work surface as desired and to flush away particles which have been removed by sanding action from the work surface W.

There is thus provided a convenient delivery of fluids to a work surface in combination with a small hand-operable sanding block by means of which the operator has the advantage of conveniently and selectively providing the fluid with the sanding in remote areas or in the delicate finishing of a job.

I claim:

1. In combination with a sanding block having a base including a lower surface and at least two opposed walls with a strip of sandpaper extending across the lower surface of the base and across the opposed walls and means releasably attaching the strip of sandpaper to the sanding block, a fluid conduit located in the base and terminating at one end in a sharpened outlet projecting beyond one wall of the base and penetrating the strip of sandpaper, the other end of the fluid conduit terminating as an inlet outwardly of another wall of the base, and means connecting said inlet end of the fluid conduit to a source of fluid.

2. A structure according to claim 1 wherein valve means are associated with the fluid conduit within the base, and means carried by the sanding block for operating the valve to control the flow of fluid through the outlet of the fluid conduit.

3. A structure according to claim 1 wherein the outlet of said fluid conduit includes a downwardly directed opening through which fluid passes.

* * * * *